US006706652B2

(12) United States Patent
Groten et al.

(10) Patent No.: US 6,706,652 B2
(45) Date of Patent: Mar. 16, 2004

(54) CLEANING CLOTH

(75) Inventors: Robert Groten, Sunhoffen (FR); Jochen Wirsching, Birkenau (DE); Frank Rudolph, Karlsruhe (DE); Joerg Dunkel, Heddesheim (DE)

(73) Assignee: Firma Carl Freudenberg, Weinheim (DE)

( * ) Notice: Subject to any disclaimer, the term of this patent is extended or adjusted under 35 U.S.C. 154(b) by 238 days.

(21) Appl. No.: 09/760,110

(22) Filed: Jan. 12, 2001

(65) Prior Publication Data

US 2001/0014393 A1 Aug. 16, 2001

(30) Foreign Application Priority Data

Jan. 22, 2000 (DE) ..... 100 02 778

(51) Int. Cl.[7] ..... D04H 1/00; D04H 13/00; D04H 3/00; D04H 5/00

(52) U.S. Cl. ..... 442/327; 442/340; 442/351; 442/360; 428/364; 428/365; 428/373

(58) Field of Search ..... 442/327, 340, 442/351, 361; 428/364, 365, 373

(56) References Cited

U.S. PATENT DOCUMENTS

| | | | | | |
|---|---|---|---|---|---|
| 4,298,649 | A | | 11/1981 | Meitner | |
| 5,725,927 | A | * | 3/1998 | Zilg et al. | 428/89 |
| 5,783,503 | A | * | 7/1998 | Gillespie et al. | 442/340 |
| 5,899,785 | A | * | 5/1999 | Groten et al. | 442/334 |
| 5,970,583 | A | * | 10/1999 | Groten et al. | 19/296 |
| 6,448,462 | B2 | * | 9/2002 | Groitzsch et al. | 602/45 |

* cited by examiner

*Primary Examiner*—Elizabeth M. Cole
*Assistant Examiner*—Norcal Torres
(74) *Attorney, Agent, or Firm*—Kenyon & Kenyon

(57) ABSTRACT

A cleaning cloth is described made of a microfilament nonwoven weighing from 30 g/m$^2$ to 500 g/m$^2$, the nonwoven being made from melt-spun, stretched continuous multicomponent filaments having a titer of 1.5 to 5 dtex, which are immediately laid down to form a nonwoven, and the continuous multicomponent filaments, optionally after pre-bonding, being split at least to 80% to form continuous micro-filaments having a titer of 0.05 to 1.0 dtex and bonded.

20 Claims, No Drawings

CLEANING CLOTH

FIELD OF THE INVENTION

The present invention relates generally to cleaning cloths and, more particularly, to a cleaning cloth made of a microfilament nonwoven weighing from 30 to 500 g/m$^2$.

BACKGROUND OF INVENTION

U.S. patent application Ser. No. 4,298,649 discloses cleaning cloths made of nonwovens. The disclosed cleaning cloths are composed of at least two layers of microfilaments having different average filament diameters. Mutually compatible and thermally meltable polymers are used as polymeric raw materials for both layers. The layers are provided with a bonding pattern using a thermal calendering process to keep the layers together.

DESCRIPTION OF THE INVENTION

The object of the present invention is to provide a cleaning cloth and a method for manufacturing a cleaning cloth that can be manufactured in a cost-effective manner for a broad range of weights per surface area.

This object is achieved according to the present invention by a cleaning cloth made of a microfilament nonwoven weighing from 30 to 500 g/m$^2$. The nonwoven is made from melt-spun, stretched, continuous, multicomponent filaments having a titer of 1.5 to 5 dtex. The filaments are immediately laid down to form a nonwoven, and the continuous multicomponent filaments are split at least to 80% to form continuous micro-filaments having a titer of 0.05 to 1.0 dtex and bonded. The filaments may be optionally pre-bonded before the step of splitting and bonding the filaments. Such a cleaning cloth has a surface structure easily penetrated by dust and fiber particles, which are then held fast. It is therefore well suited as a cleaning cloth.

Preferably, the continuous multicomponent filament is a continuous bicomponent filament made of two incompatible polymers. In particular, a polyester and a polyamide are suitable polymers. Such a continuous bicomponent filament has good splittability into continuous micro-filaments, resulting in an advantageous strength to weight per surface area ratio.

Preferably, the continuous multicomponent filaments have a cross-section with an orange-type or "pie" type multisegment structure, with the segments containing alternately one of the two incompatible polymers. In addition to this orange-type multisegment structure of the continuous multicomponent filaments, a side-by-side (s/s) arrangement of the incompatible polymers in the continuous multicomponent filament with two or more strips is also possible. The side-by-side arrangement is preferably used for producing curled filaments. Such arrangements of the incompatible polymers in the continuous multicomponent filaments have proven to be very easy to split.

At least one of the incompatible polymers forming the continuous multicomponent filament preferable contains additives. Suitable additives are coloring pigments, permanent-effect antistatic agents, fungicides, bactericides, acaricides, and/or additives affecting the hydrophilic or hydrophobic properties in amounts up to 10% eight. The cleaning cloth made of spin-dyed fibers has good washability. Furthermore, static charges can be reduced or avoided and moisture transport properties can be improved using the additives.

The method of manufacturing the cleaning cloth according to the present invention includes spinning the continuous multicomponent filaments from a melt. The multicomponent filaments are stretched, and immediate laid down to form a nonwoven. Optionally the non-woven is subjected to pre-bonding at this stage. Finally, the non-woven is bonded using high-pressure fluid jets at this point which results in splitting at the same time into continuous micro-filaments having a titer of 0.05 to 1.0 dtex. The cleaning cloth produced by this method has a very uniform thickness and has an isotropic fiber distribution. Furthermore, the cleaning cloth has no tendency to delaminate and is distinguished by a higher modulus value than comparable staple fiber nonwovens.

Preferably, the continuous multicomponent filaments are bonded and split by exposing the pre-bonded nonwoven to high-pressure water jets at least once on each side. The cleaning cloth thus obtains a high degree of surface homogeneity and a splitting degree of the continuous multicomponent filaments>80%.

A particularly preferred method includes the step of spin dying the continuous multicomponent filaments. Fixation of the dyes in the polymer fibers in this manner results in excellent washability.

Cleaning cloths with specific weights, and optionally additional treatments, are particularly suited for certain uses. For example, cleaning cloths having a weight of 40 to 240 g/m$^2$, optionally also napped, emerized, brushed, or spot-calendered, are preferably used as all-purpose and/or rinsing cloths. Cleaning cloths having a weight of 40 to 140 g/m$^2$, optionally also imprinted, are particularly suited for use as sanitary cleaning cloths. Cleaning cloths weighing 80 to 200 g/m$^2$, optionally also coated, embossed, and/or imprinted, are particularly suited for use as window and/or glass cloths. Cleaning cloths weighing 100 to 250 g/m$^2$, optionally also embossed and pre-impregnated with a cleaning agent, are particularly suited for use as building cleaning cloths.

Cleaning cloths weighing 100 to 280 g/m$^2$, optionally also napped, emerized, brushed, and/or imprinted, are particularly suited for use as dusting cloths. Cleaning cloths weighing 140 to 500 g/m$^2$, optionally also napped, emerized, brushed, and/or imprinted, are particularly suited for use as floor cloths.

Further features of the cleaning cloth according to the present invention are good water absorption, short drying time, and low cleaning agent consumption. These features result in good washing, hygienic and care properties, as well as suitability as cleaning cloths, since quick drying removes the water necessary for microbial growth, thus reducing the development of bacteria and/or fungus colonies on the cleaning cloth.

The cleaning cloth is advantageously impregnated with a cleaning and/or care agent. Ionic or non-ionic surface active agents such as sodium sulfo-succinate or the respective dioctyl ester in amounts from 0.1 to 1.0 wt. % can be used as the cleaning agent. Agents containing wax or paraffin oil can be used as care agents. Pre-impregnation is particularly useful in cleaning cloths used by professional cleaners. Pre-impregnation saves time, since constant application of new chemicals is no longer necessary. At the same time, incorrect dosages are generally avoided.

The cleaning cloth according to the present invention can advantageously be washed in boiling water (95° C.) a plurality of times. This increases the useful life of the cleaning cloth under perfectly hygienic conditions, and usability in professional practice is simplified by machine washing of the used cleaning cloths and, if necessary, by pre-impregnation with cleaning and/or care agents.

The present invention is further described below in conjunction with two examples of a cleaning cloth built in accordance with the principles of the invention already discussed.

EXAMPLE 1

A filament nonwoven weighing 130 g/m$^2$ is manufactured from a polyester-polyamide (PES-PA) continuous bicomponent filament. The nonwoven subjected to water jet needle punching at a pressure of up to 250 bar on both sides. After needle punching, which results in splitting of the initial filaments at the same time, the continuous bicomponent filaments have a titer of 0.1 dtex. For cleaning cloths made of continuous micro-filaments, maximum tensile forces of 450 N were measured in the longitudinal direction and of 340 N in the transverse direction. The modulus at 10% elongation was 142 N in the longitudinal direction and 55 N in the transverse direction. The tear propagation force was 15 N in the machine direction and 18 N across machine direction.

EXAMPLE 2

A filament nonwoven weighing 105 g/m$^2$ is manufactured from a polyester-polyamide (PES-PA) continuous bicomponent filament. The nonwoven is subjected to water jet needle punching at a pressure of up to 250 bar on both sides. After needle punching, which results in splitting of the initial filaments at the same time, the continuous bicomponent filaments have a titer of 0.1 dtex. For cleaning cloths made of continuous micro-filaments, maximum tensile forces of 336 N were measured in the longitudinal direction and of 279 N in the transverse direction. The modulus at 10% elongation was 93 N in the longitudinal direction and 31 N in the transverse direction.

Table 1 shows a comparison of the mechanical properties of the two disclosed examples according to the present invention with those of two cleaning cloths made of two staple fiber nonwovens.

The maximum tensile forces in the longitudinal direction of the cleaning cloth according to the present invention were approx. 38% higher than the staple fiber nonwoven weighing 155 g/m$^2$ used for a comparison and approx. 55% higher than a staple fiber nonwoven weighing 80 g/m$^2$. The cleaning cloth according to the present invention has clearly higher modulus values and, despite its lower weight per surface area, has comparable tear propagation resistance values.

| | Example 1 approx. 130 g/m$^2$ | Example 2 approx. 105 g/m$^2$ | Staple Fiber Nonwoven approx. 155 g/m$^2$ | Staple Fiber Nonwoven approx. 90 g/m$^2$ |
|---|---|---|---|---|
| Tearing force (long.) | 450 N | 336 N | 325 N | 289 N |
| Tearing force (trans.) | 340 N | 279 N | 323 N | 177 N |
| Elongation (long.) | 49% | 50% | 45% | 47% |
| Elongation (trans.) | 53% | 51% | 66% | 57% |
| Modulus 10% (long.) | 142 N | 93 N | 67 N | 37 N |

-continued

| | Example 1 approx. 130 g/m$^2$ | Example 2 approx. 105 g/m$^2$ | Staple Fiber Nonwoven approx. 155 g/m$^2$ | Staple Fiber Nonwoven approx. 90 g/m$^2$ |
|---|---|---|---|---|
| Modulus 10% (trans.) | 55 N | 31 N | 17 N | 10 N |
| Tear Propag. Force (long.) | 15 N | — | 17 N | 7 N |
| Tear Propag. Force (trans.) | 18 N | — | 17 N | 11 N |

What is claimed is:

1. A cleaning cloth comprising a microfilament nonwoven weighing from 30 g/m$^2$ to 500 g/m$^2$, wherein the nonwoven is made from melt-spun, stretched continuous multicomponent filaments having a titer of 1.5 to 5 dtex, which are immediately laid down to form a nonwoven, and the continuous multicomponent filaments after pre-bonding, are split at least to 80% to form continuous micro-filaments having a titer of 0.05 to 1.0 dtex and bonded, wherein the filaments have an isotropic fiber distribution.

2. The cleaning cloth according to claim 1, wherein the nonwoven is made of melt-spun, aerodynamically stretched continuous multicomponent filaments having a titer of 2 to 3 dtex, which are immediately laid down to form a nonwoven, and the continuous multicomponent filaments, optionally after pre-bonding, are split at least to 80% to form continuous micro-filaments having a titer of 0.1 to 0.5 dtex and bonded.

3. The cleaning cloth according to claim 1, wherein the continuous multicomponent filament is a continuous bicomponent filament made of two incompatible polymers.

4. The cleaning cloth according to claim 3, wherein the incompatible polymers are a polyester and a polyamide.

5. The cleaning cloth according to claim 3, wherein at least one of the incompatible polymers forming the continuous multicomponent filament contains additives such as coloring pigments, permanent-effect antistatic agents, fungicides, bactericides, acaricides, and/or additives influencing the hydrophilic or hydrophobic properties in amounts up to 10 wt. %.

6. The cleaning cloth according to claim 1, wherein the continuous multicomponent filaments have a cross-section with an orange-type multisegment structure, the segments containing alternately one of the two incompatible polymers.

7. The cleaning cloth according to claim 1, wherein the continuous multicomponent filaments have a side-by-side structure with two or more strips.

8. The cleaning cloth according to claim 1, wherein the muiticomponent filaments forming the two sides of the cleaning cloth have different segment structures.

9. The cleaning cloth according to claim 1, wherein the cloth weighs 40 g/m$^2$ to 240 g/m$^2$ and is suitable for use as an all purpose and/or rinsing cloth.

10. The cleaning cloth according to claim 9, wherein the cloth is napped, emerized, brushed, or spot-calendered.

11. The cleaning cloth according to claim 1, wherein the cloth weighs 80 g/m$^2$ to 200 g/m$^2$, and is suitable for use as a window and/or glass cloth.

12. The cleaning cloth according to claim 11, wherein the cloth is coated, embossed, and/or imprinted.

13. The cleaning cloth according to claim 1, wherein the cloth weighs 100 g/m$^2$ to 250 g/m$^2$, and is suitable for use as a building cleaning cloth.

14. The cleaning cloth according to claim 13, wherein the cloth is embossed and pre-impregnated with a cleaning agent.

15. The cleaning cloth according to claim 1, wherein the cloth weighs 100 g/m$^2$ to 280 g/m$^2$, and is suitable for use as a dusting cloth.

16. The cleaning cloth according to claim 15, wherein the cloth is napped, emerized, brushed, and/or imprinted.

17. The cleaning cloth according to claim 1, wherein the cloth weighs 140 g/m$^2$ to 500 g/m$^2$, and is suitable for use as a floor cloth.

18. The cleaning cloth according to claim 17, wherein the cloth is napped, emerized, brushed, and/or imprinted.

19. The cleaning cloth according to claim 1, wherein the cloth is impregnated with a cleaning and/or care agent.

20. The cleaning cloth according to claim 1, wherein the cleaning cloth can be washed in boiling water (95° C.) a plurality of times.

* * * * *